US007559552B2

(12) United States Patent
Shoemaker, Jr.

(10) Patent No.: US 7,559,552 B2
(45) Date of Patent: Jul. 14, 2009

(54) COIN ROULETTE ARCADE GAME

(76) Inventor: Stephen Shoemaker, Jr., 531 N. Francisca Ave., Redondo Beach, CA (US) 90277

( * ) Notice: Subject to any disclaimer, the term of this patent is extended or adjusted under 35 U.S.C. 154(b) by 6 days.

(21) Appl. No.: 11/603,535

(22) Filed: Nov. 22, 2006

(65) Prior Publication Data

US 2008/0116631 A1 May 22, 2008

(51) Int. Cl.
*A63F 1/00* (2006.01)

(52) U.S. Cl. ..... 273/138.3

(58) Field of Classification Search ..... 273/138.3
See application file for complete search history.

(56) References Cited

U.S. PATENT DOCUMENTS 4,662,636 A * 5/1987 Crompton ..... 273/138.2
5,275,402 A * 1/1994 Malavazos et al. ..... 273/138.2
5,417,435 A * 5/1995 Peretz ..... 273/355
5,462,286 A * 10/1995 Roberts ..... 273/459
5,553,865 A * 9/1996 Shoemaker et al. ..... 273/448
5,622,366 A * 4/1997 Inoue ..... 273/138.2
5,707,060 A * 1/1998 Ogane et al. ..... 273/138.2
6,092,807 A * 7/2000 Yu ..... 273/144 R
6,254,479 B1 * 7/2001 Okitani et al. ..... 463/7
6,629,887 B1 * 10/2003 Todaiji et al. ..... 463/2
6,899,328 B2 * 5/2005 Halliburton et al. ..... 273/138.1

* cited by examiner

*Primary Examiner*—Gene Kim
*Assistant Examiner*—Dolores Collins
(74) *Attorney, Agent, or Firm*—Fulwider Patton LLP

(57) ABSTRACT

An arcade game is disclosed having a rotating roulette type wheel with holes along a concentric circle of the upper face, and a coin track for carrying a coin from a player to the roulette type wheel at the position of the holes, which serve as targets. An optical sensor signals a microprocessor that a coin is entering the rotating playing field, and a second optical detector detects the nearest target and communicates a target value to the microprocessor. The microprocessor compares the timing of the coin passing through the coin track and the passage of the most proximal target, and awards the target value of the time between the two events is within a predetermined interval.

6 Claims, 1 Drawing Sheet

COIN ROULETTE ARCADE GAME

BACKGROUND OF THE INVENTION

The present invention relates generally to arcade style amusement games of chance, and more particularly to an arcade game where a coin or token is dispatched down a track to enter a rotating roulette wheel type playfield where electronic sensors determine a score based on a proximate target.

Arcade games that measure a player's skill and luck are well known in the art. The present inventor is also the inventor and owner of many popular games found in today's arcades. For example, U.S. Pat. No. 4,272,082, entitled "Coin Projecting Amusement Device," discloses an amusement wherein coins may be controllably deposited by the player on a playing surface having a multiplicity of surface interruption means thereon. A vertical dam translates over at least a portion of said playing surface and pushes said deposited coins against a random pattern of accumulated coins, causing some of said accumulated coins to fall over an edge into a collecting and counting means. This game is marketed and sold under the trademark "Wedges and Ledges." U.S. Pat. No. 4,303,248, also invented by the present inventor, discloses an amusement game where coins are dropped onto a flat surface over which a vertical dam is horizontally translated. The vertical dam translates over a portion of the flat surface and drops a certain of the accumulated coins over the edge. As the coins drop over the edge, they are collected in a counting chute to be synchronously counted in a memory which is then unloaded to vend out a corresponding number of tokens.

U.S. Pat. No. 4,726,585 also discloses an amusement apparatus in which a player controls a pushing device to push items off of a playing field. A moveable surface is driven in a first pre-determined path and the pusher device is moveable in a linear path traverse to the path travel of the moveable surface. A delivery passage at one end of the path of the pusher device is arranged to deliver any item swept off the surface to a retrieval bin. U.S. Pat. No. 4,822,045 is directed to an amusement device comprised of a pair of spaced apart elongate members defining a track, and a rolling member for rolling along that track under control of an operator. The elongate members are spaced a fixed distance apart at their first ends since this ends comprising since this end comprising the normal home position of the rolling member. The opposite, second ends of the elongate members are moveable relative to one another to adjust their spacing and to control the movement of the rolling member along the track. The operator controls the separation of the elongate member so that the rolling member can roll from its home position to the opposite end of the track without falling between the opening separating the elongate members.

U.S. Pat. No. 5,553,865 discloses a rotary arcade game including a turn table having a central aperture. Prizes are positioned on the surface of the turn table and moved by a pivoting arm member operated by the player. The player attempts to manipulate an arm member to push prizes into a collection pocket where they are detected and dispensed to the player. U.S. Pat. No. 5,855,374 is directed to a crane game using a vacuum to selectively pick up prizes within a bin. The prizes are arrayed on a rotating turn table, and the player manipulates a vacuum pick up device linearly along a radial direction of the turn table to pick up prizes below. U.S. Pat. No. 6,139,429 discloses another crane game using a video screen for displaying images. A maneuverable sensor contacts the display screen to select prizes displayed thereon. U.S. Pat. No. 6,095,519 discloses an arcade game including a directing mechanism for aiming a game piece such as a token.

U.S. Pat. No. 6,598,881 discloses a crane game with a prize redistribution mechanism for dispersing prizes to a substantially level configuration. Finally, U.S. Pat. No. 6,770,001 discloses a vacuum crane game with targets having beaded portions that vary the difficulty of acquiring said targets.

The foregoing illustrate arcade type games credited to the present inventor. The games are predominantly skill-based with an element of luck woven into the overall operation of the games. The present invention is the inventor's most recent creation in this line of arcade type games.

SUMMARY OF THE INVENTION

The present invention is an arcade game that can be simultaneously played by one or more players, and includes a rotating playing field with a plurality of circumferentially spaced holes serving as targets. The holes or targets are assigned a point value and the point value is indicated by demarcations adjacent each target so that the player can easily determine which targets have the highest point value. The rotating playing field is enclosed in a transparent housing to prevent the player or onlookers from influencing the play. An elongate track extends from a chute just outside of the transparent housing and above the playing field, down to the playing field, where the track's width is narrow and sized to carry a coin or token under the influence of gravity down the track in a rolling manner. The end of the track leads directly to the playing field, and more precisely to a radial position on the playing field in which all of the targets lie. As the playing field rotates, each target on the playing field sequentially passes by the end of the coin track. The determination of which target a coin will "hit" is determined solely by the player's timing in coordinating the travel of the coin down the track with the rotation of the playing field and associated movement of the desired target. The player thus attempts to time the placement of the coin or token in the chute, which causes the coin to travel under the influence of gravity down the track, with the arrival of the desired target so as to achieve the best score.

The game may be equipped with multiple chutes arranged around the perimeter of the housing that are coupled to their own coin tracks, allowing many players to participate simultaneously. In order to determine which player scores which target, each coin track is provided with an optical sensor disposed above the rotating playing field that detects the passage of a coin having a correct trajectory, but does not detect a coin with an incorrect trajectory, and sends a signal to a microprocessor if a coin is detected. The microprocessor receives the signal from the optical sensor and determines the nearest target to the exit of the coin track, and awards the player the value of the target based on this determination. The game can then dispense tickets, prizes, or otherwise score points based on the accuracy and the luck of the players in shooting the coin at their intended targets. The game can also be made more difficult by adding mechanical mechanisms to oscillate the end of the track, making it more challenging for the player to obtain the correct trajectory.

Other features and advantages of the invention will become apparent from the following detailed description, taken in conjunction with the accompanying drawings which illustrate, by way of example, the features of the invention

DETAILED DESCRIPTION OF THE PREFERRED EMBODIMENTS

Figure 1:
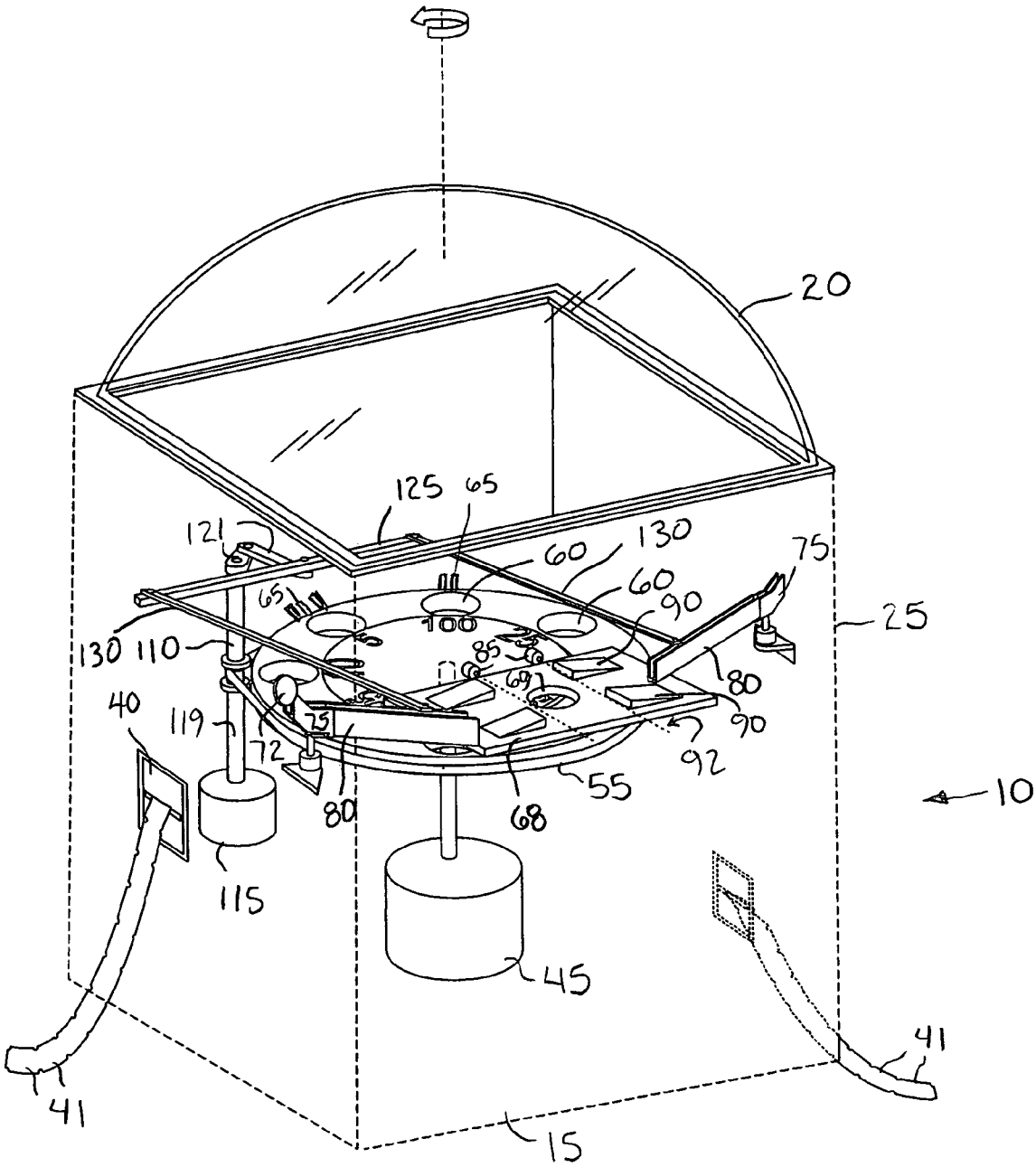
FIG. 1 is an elevated perspective view of a first preferred embodiment of the present invention.

For a better understanding of the present invention together with other and further objects, advantages and capabilities thereof, reference is made to the following disclosure and appended claims in connection with the above described drawing. FIG. 1 illustrates a general depiction of a first preferred embodiment of the present invention wherein an arcade game 10 comprises a housing 15 wherein the upper half of the housing 20 is at least partially transparent and encloses a game area to protect the game from interference or tampering. In a preferred embodiment, the upper half of the housing 20 is configured to include a transparent dome so that the game may be viewed by players and observers. Alternatively, the dome can be replaced by a flat panel, pyramid, or other structure as the main consideration is the ability of the players to watch the action. The lower half 25 of the housing 15 stores the electronics and operational components to be described more fully below to enable the game to be played.

On at least one lower panel is a ticket dispenser 40 for dispensing redemption tickets 41, coupons, receipts, or the like as is known in the art. Such ticket dispensers 40 are notorious in this field and the construction and operation of the ticket dispensers are not part of the present invention. Tickets 41 are awarded to the player based on commands from a microprocessor that controls the operation of the game and the distribution of rewards. FIG. 1 also illustrates additional features of the game 10 including an electric motor 45 that is connected to a power source (not shown). The motor 45 drives a large rotating playing field or wheel 55 at a constant speed in a similar manner to the popular roulette wheels used in gaming casinos. The upper surface of the rotating playing field 55 includes concentrically aligned holes 60 arranged at a common radial position adjacent the outer edge. Each hole 60 is assigned a point value and establishes a target for the player to aim for. That is, one hole may represent a value of "100" and a second hole may represent a value of "10." If a player is deemed to have successfully landed a coin at the target, the ticket dispenser 40 dispenses tickets 41 based on the value of the target.

Located on the side of the rotating playing field 55 adjacent each hole are projections 65 of varying number. The projections 65 are read by an optical sensor (not shown) positioned within the housing adjacent the rotating wheel. The optical sensor reads the projections 65 as each target 60 passes by, where the spacing and number of the projections 65 correspond with a specific target on the wheel. The sensor sends a signal to a microprocessor within the housing 15 that interprets the signal as a location of the wheel at the sensor, which is used to determine the location of the targets adjacent each chute. In this manner, the microprocessor tracks the target 60 that most recently passed the chute at all times the game is powered on.

At each wall of the game is a coin chute 75 into which a player can deposit a token, coin, or the like 72. The coin chute 75 leads to a downwardly inclined curved coin track 80. A coin 72 placed in the chute 75 will enter and travel down the track 80 onto the rotating playing field 55. As the coin exits the track 80 it encounters a surface 68 supported just above the rotating playing field 55. The surface 68 includes a hole 69 that coincides with the radial distance of the targets 60 and is similarly sized. The surface 68 carries ramps on either side of the path between the end of the chute 80 and the hole 69, where such path defines a winning path.

On opposite sides of the surface 68 is one or more optical readers 85 that detects the passage of a coin and relays a signal to the processor 50 that a coin is exiting the track 80. The optical reader 85 is positioned so that only a coin that maintains contact with the surface 68 will trigger a successful shot. If the sensor reads a coin as passing along the winning path, the processor then compares the time from the most recent passage of a target 60 to determine the nearest target, and awards a point value corresponding to the most proximal target. Once the microprocessor determines the most proximal target, the microprocessor commands the ticket dispensing machine 40 to dispense tickets corresponding to the predetermined value of the target. However, adjacent the optical sensor 85 on each side of the path to the target are ramps 90 extending a height above the sensor 85. If the coin or token 72 exits the chute 80 and encounters a ramp 90 it will be diverted over the sensor's optical beam 92 and thus not be recognized by the microprocessor. Accordingly, a coin that fails to register with the optical sensor 85 is deemed to be a failed attempt and no points are awarded for this try.

A player can test his skill by timing the gravitationally driven token or coin 72 to exit the track 80 coinciding with the passage of the higher value targets, and thus earn the highest ticket value. The determination of whether there has been a successful score is determined by the optical reader 85, and the microprocessor which determines the position of the wheel and extracts the nearest target when the coin exits the chute and actuates the sensor 85. The microprocessor 50 can also be programmed to require the most proximal target be within a predetermined distance from the end of the chute before awarding a winning score. That is, the microprocessor will not award a winning score despite the sensor 85 determining that a coin has successfully passed through the path to the target if the target is determined to be spaced too far from the hole 69 as the coin exits the chute 80. The proximity of the target to the hole 69 can be adjusted to vary the required skill level. In other words, the range of delay between the passage of the target and the entrance of the coin onto the playing field can be set to 2 to 3 tenths of a second for higher accuracy, to a full second or more for lower accuracy, where if the passage is within the tolerance the microprocessor interprets the attempt as a successful hit. This determination eliminates the need for the coin to actually enter and stay in the hole/target, which is irrelevant for purposes of winning the tickets.

The present embodiment allows for multiple players to play simultaneously. Otherwise, if a coin 72 entered a target 60 it would be difficult to determine whose coin entered the target. By tying the success of the player to the proximity of the coin to a moving target, with sensors adjacent each player's chute, the need to determine whether a coin entered the target hole and which player's coin entered target is eliminated which greatly simplifies the game. Each player can thus win or lose simultaneously and the game keeps track of each attempt by each player and awards tickets, scores, points or the like accordingly.

There may be alternative methods in which the token is put in play in the game, which can make the game more random. In the above described embodiment, the player fully controls the timing of the coin apart from the influence of gravity. However, a coin acceptor can be employed that recognizes the presence of a coin that initiates a game sequence in the microprocessor 50. The acceptor then drops the coin onto the coin track after a random delay controlled by the microprocessor, such that the element of skill is eliminated from the game.

The difficulty can also be adjusted by adding a mechanical shaker 110 that oscillates the chutes 80 using a linkage. The shaker 110 is driven by the same motor 45 as drives the rotating playing field, or the shaker can be driven by a separate motor 115 as shown in the figure. The shaker 110 includes a rod 119 driven by the motor and coupled via pivoting links 121 to a cross bar 125. The cross bar 125 is coupled to shaker arms 130 that are fixed to the chutes 80. When the motor 115 is actuated, the rod 119 rotates causing the pivoting links to move in a circular manner. The pivoting links 121 are fixed to the cross bar 125 and cause the shaker arms 130 to reciprocate back and forth, which in turn causes the ends of the chutes to undulate in a predictable pattern. This pattern can be timed by the player, but adds a degree of difficult to the game as a coin will be off-center if the player's timing is not correct.

The above described embodiments are intended to be illustrative but not limiting to the scope of the present invention, the breadth of which is intended to be governed solely by the words of the appended claims. Those skilled in the art will readily envision various changes and alternate embodiments that fall within the scope of the present invention, and the claims are intended to include all such changes and alternate embodiments.

I claim:

1. A coin roulette amusement game comprising:

a rotating playing field disposed in a housing, and including a plurality of targets spaced about a concentric circle, said targets having a value associated therewith;

a coin track extending at a first end from said housing above said playing field to a second end at the playing field, said coin track sized to carry a coin rolling under the influence of gravity from said first end to said second end to deliver said coin to said playing field;

an optical sensor disposed at said second end of said coin track to detect the passage of a rolling coin onto the playing field from said coin track, and signaling means for communicating a signal from the optical sensor that said rolling coin has entered the playing field from the coin track;

a microprocessor coupled to said signaling means for receiving said signal that a rolling coin has entered the playing field from the coin track, and further having means for determining a most proximal target to be intercepted by a path of said rolling coin entering said playing field, and further determining if said most proximal target passes by said rolling coin within a predetermined passage of time, whereby a winning attempt occurs when said most proximal target passes by said rolling coin within said predetermined passage of time.

2. The coin roulette game of claim 1 further comprising a ticket dispensing mechanism for dispensing redemption tickets corresponding to said assigned score.

3. The coin roulette game of claim 2 wherein the means for determining a most proximal target comprises:

a plurality of projections extending radially from said rotating playing field, where a number of projections corresponds to a value of an adjacent target, and a sensor coupled to said microprocessor for detecting and communicating the number of projections on the rotating playing field to a microprocessor, whereby the microprocessor converts the number of projections to a target value and causes the ticket dispensing mechanism to dispense tickets based on said target value.

4. The coin roulette game of claim 1 further comprising a plurality of coin tracks, each coin track provided with its own optical sensor, whereby the microprocessor assigns a score based on the means for determining a most proximal target and the each signaling means corresponding to the value of the most proximal target for each coin track when the optical sensor detects a passage of a coin from said each coin track.

5. The coin roulette game of claim 1 wherein the microprocessor incorporates a delay between the signaling means communicating a signal from the optical sensor to the microprocessor that a coin has entered the playing field from the coin track, and the means for determining a most proximal target determines a target value of a most proximal target, to compensate for a time required for the coin to travel from the optical reader to the playing field.

6. The coin roulette game of claim 1 wherein said microprocessor determines whether a coin exiting said coin track is close enough to a target to award a target value, and commands said ticket dispenser to dispense redemption tickets only if said microprocessor determines that the coin was proximal to a target when said coin exits said coin track.

* * * * *